United States Patent [19]

Michaelis

[11] 3,954,326

[45] May 4, 1976

[54] TRANSLUCENT BUILDING BLOCKS

[76] Inventor: Maximilian Gustav Alfred Cecil Michaelis, 13 Quai St. Michel, Paris V, France

[22] Filed: Feb. 25, 1974

[21] Appl. No.: 445,699

[30] Foreign Application Priority Data

Jan. 3, 1974 United Kingdom ..... 273/74

[52] U.S. Cl. ..... 350/265; 52/306

[51] Int. Cl.[2] ..... E04C 1/42

[58] Field of Search ..... 350/258, 259, 260, 261, 350/262, 264, 265; 240/106 R, 107; 52/171, 172, 306, 307, 308

[56] References Cited

UNITED STATES PATENTS

| | | | |
|---|---|---|---|
| 650,209 | 5/1900 | White | 350/260 |
| 1,949,898 | 3/1934 | Cochrane et al. | 52/306 |
| 2,158,089 | 5/1939 | Slick | 52/306 |
| 2,162,160 | 6/1939 | Cooley et al. | 350/258 |
| 2,163,454 | 6/1939 | Slick | 52/308 |
| 2,179,862 | 11/1939 | Rolph | 350/262 |
| 2,226,220 | 12/1940 | Cox | 52/306 |
| 2,844,998 | 7/1958 | Vincent | 350/260 |
| 3,059,537 | 10/1962 | Walli | 350/264 X |
| 3,252,260 | 5/1966 | Mills | 52/308 X |
| 3,471,221 | 10/1969 | Seeger | 350/265 X |

FOREIGN PATENTS OR APPLICATIONS

| | | | |
|---|---|---|---|
| 16,568 | 8/1897 | United Kingdom | 350/262 |
| 1,294,308 | 10/1972 | United Kingdom | 350/265 |

*Primary Examiner*—L. T. Hix
*Assistant Examiner*—Alan Mathews
*Attorney, Agent, or Firm*—Seidel, Gonda & Goldhammer

[57] ABSTRACT

A hollow building block of transparent material comprises four perpendicular walls defining a rectangle, and a partition wall extending obliquely with respect to a plane at right angles to said perpendicular walls, said partition wall forming a boundary of a hollow space within said building block for containing liquid and the arrangement being such that when said hollow space is partially filled with a transparent liquid, light incident upon one of said perpendicular walls of the block can be reflected through said block by total internal reflection at a portion of said oblique wall immersed in said liquid.

9 Claims, 8 Drawing Figures

TRANSLUCENT BUILDING BLOCKS

FIELD OF THE INVENTION

This invention relates to translucent building blocks, and more especially to a building block which is an improvement in that described in British Patent Specification No. 1,294,308.

DESCRIPTION OF THE PRIOR ART

In British Patent Specification No. 1,294,308, there is described a building block comprising a hollow transparent body partially filled with a liquid and having at least one oblique wall such that light can be reflected through the body of the block by total internal reflection at a portion of the oblique wall immersed in said liquid. Such a building block, if desired in combination with a number of other such blocks, has the advantage that it is capable of transmitting light through a wall in a novel and visually attractive manner. However, where the thickness of the wall is limited, and the block is required to be accommodated within the thickness of the wall, the presence of the oblique wall of the block has the disadvantage of reducing the load bearing capacity of the structure.

OBJECTS OF THE INVENTION

It is accordingly an object of the present invention to overcome this disadvantage.

SUMMARY OF THE INVENTION

The invention consists in a hollow building block of transparent material comprising four perpendicular walls defining a rectangle, and a partition wall or insert extending obliquely with respect to a plane at right angles to said perpendicular walls, said partition wall forming a boundary of a hollow space within said building block for containing liquid and the arrangement being such that when said hollow space is partially filled with a transparent liquid, light incident upon one of said perpendicular walls of the block can be reflected through said block by total internal reflection at a portion of said oblique wall immersed in said liquid.

The arrangement according to the invention has the advantage that the four perpendicular walls of the block form a load bearing structure, whilst the oblique partition wall in combination therewith provides a light transmitting arrangement having optical characteristics similar to the building block of British Patent Specification No. 1,294,308.

The present invention also provides a module comprising a plurality of building blocks as set forth above arranged in a rectangular frame vertically and horizontal adjacent to one another, the module being adapted to form part of a wall structure of a building.

SHORT DESCRIPTION OF THE DRAWINGS

The invention will now be described by way of example with reference to the accompanying drawings, in which.

DESCRIPTION OF PREFERRED EMBODIMENTS OF THE INVENTION

Figure 1:
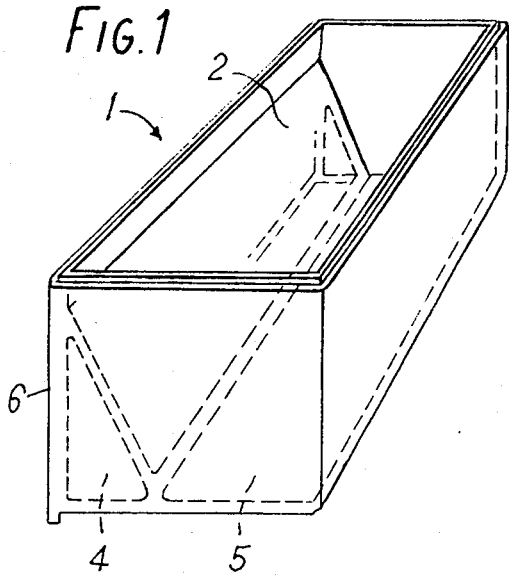
FIG. 1 is a perspective view of a building block according to the invention.
Figure 2:
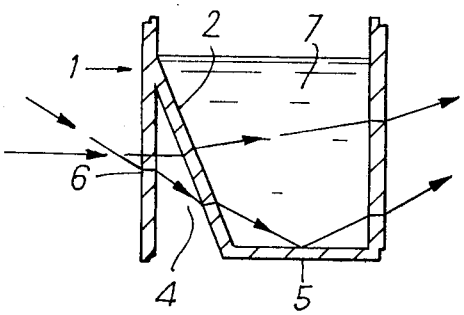
FIG. 2 is a cross-section of the building block of FIG. 1, taken along the line II—II.
Figure 3:
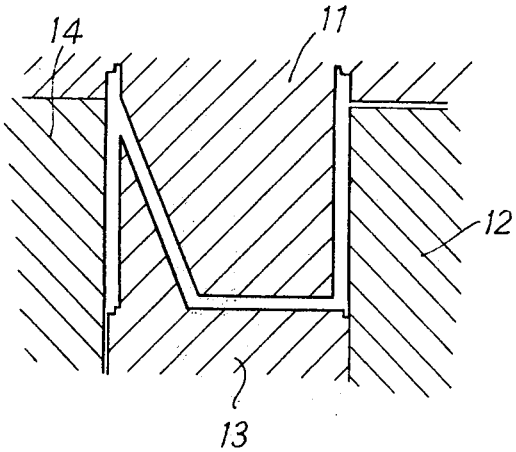
FIG. 3 is a cross-section of a mould for another building block according to the invention.

In FIG. 1, a generally rectangular building open topped block 1 of a transparent material such as glass comprises four rectangular side walls. A partition wall 2, of the same transparent material, is formed obliquely to a floor 5 of the block but nonetheless perpendicular to the ends (the block being viewed end-on in FIG. 1). The wall 2 extends from end to end of the block 1. The floor 5 however does not extend beyond the left (FIG. 2) of the partition wall 2; thus it leaves a gap 4. As shown in FIGS. 1–3 for example, the transverse dimension of the horizontal floor 5 exceeds the corresponding dimension for the oblique portion of the bottom wall.

It will be seen that the base of the block 1 has angled recessed longitudinal edges conforming with longitudinal angled projections in the top of the block, whereby blocks can be stacked and positively located. In practice, stacked blocks would be cemented together, but during assembly the projections and recesses will be of assistance. Various arrangements are possible.

Figure 4:
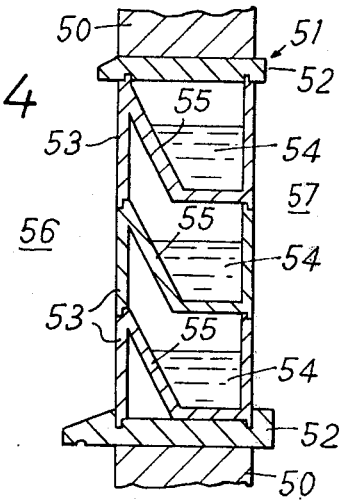
FIG. 4 is an end view of a module containing three superimposed blocks made in the mould of FIG. 3.

In use, the block 1 is partially filled with a transparent liquid 7 such as water; several like blocks are then stacked one upon another, generally as shown in FIG. 4. The arrows in FIG. 2 illustrate light rays and the manner in which they are reflected.

If desired, the block 1 may, after receiving the liquid 7, be closed by a slip of glass (not shown) cemented to the top of the block 1 and so dimensioned as to seal the volume containing the liquid without interfering with the superimposition of the next block 1. In such a case, the volume not occupied by the liquid 7 can contain a coloured gas.

FIG. 3 shows a mould for forming a building block as shown in FIGS. 1 and 2.

Bottom and top parts 13 and 11 define the upper and lower limits of the block, while side parts 12 and 14 define the lateral limits. Between the bottom part 13 and the side part 14 a sprue is defined, and between the top part 11 and the side part 12 another sprue is defined.

FIG. 4 shows a vertical cross-section of a module according to the invention. A wall 50 of a building has an aperture in which is inserted a module 51. The module comprises a rectangular frame 52 formed as a window frame and contains in superimposition a plurality of, for example, three rectangular building blocks 53 similar to those resulting from the mould of FIG. 3 and according to the invention. The module may include any number of horizontally adjacent blocks.

Transparent liquid 54 in each block reaches the obliquely formed internal wall 55. All joints in the module are, of course, hermetically sealed where necessary to prevent leakage or evaporation of the liquid 54.

In the unusual eventuality of incident light emanating from below the horizontal, the oblique walls would be arranged in the opposite sense to that shown in FIG. 5, so that they still extended generally parallel to the incident light.

Figure 5:
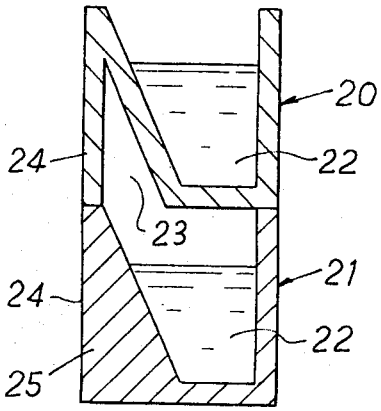
FIG. 5 is a cross-section of a module comprising two superimposed building blocks according to the invention.

Examples of further building blocks provided by the present invention are shown in FIG. 5 of the accompanying drawings, in which, as seen in end elevation, an open-topped glass building block 20, with its base smaller than its top but otherwise generally rectangular, is superimposed on a generally similar block 21. Both contain a translucent liquid such as water 22.

A downward extension 24 of the block 20 causes the area 23 of the open top of the block 21 not covered by the base of the block 20 to be sealed; the rectangular ends of the blocks 20, 21 (parallel to the plane of the paper of FIG. 5) consists of glass walls. This design offers a seal all round and obviates the need for the flat seal previously used to enclose the liquid when consecutive bricks were reversed.

The volume 25 represents a reduced reverse of the volume in which the liquid is placed and can be partly or (as shown) in whole filled in with glass, depending on technical considerations. Contact of the inclined plane with the water 22 provides a refracting surface. The solid glass volume 25 may indeed offer convenient facilities in producing a mould.

A wall consisting of blocks 21 stacked can also have consecutive blocks reversed without needing any extra seals to retain the water 22 or other liquid.

Figure 6A:
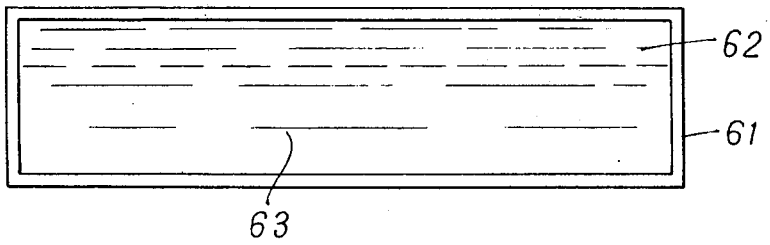
FIG. 6 is a cross-section of another building block according to the invention.
Figure 6B:
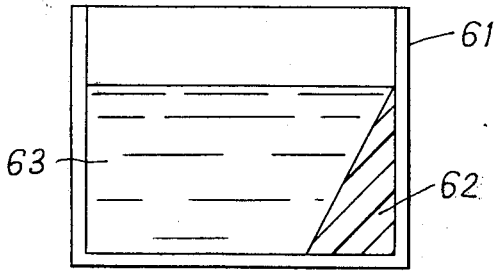
Figure 6C:
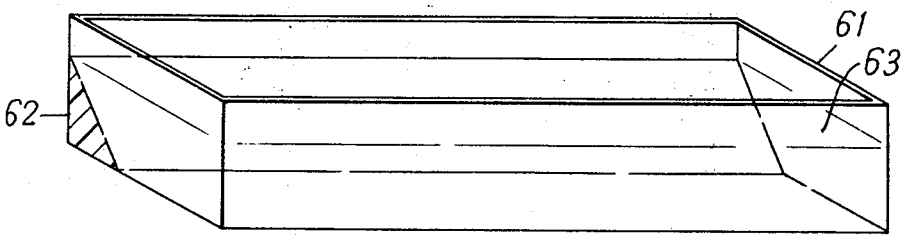

FIG. 6 shows a further building block according to the invention, FIG. 6*a* being a plan, FIG. 6*b* a schematic U.S. end elevation to an enlarged scale and FIG. 6*c* an oblique isometric drawing.

An open-topped hollow orthorhombic glass block 61 contains an insert 62 of perspex (a transparent plastics material prepared by the polymerisation of methyl methacrylate). The insert 62 could alternatively be of glass or any other transparent solid. The insert 62 is a right cylinder of right-triangular section and fits snugly in a corner of the block 61 intended to be horizontal and parallel to the plane of the wall of which the block is to form part. The insert 62 is just as long as the relevant interior dimension of the block.

The block 61 contains a transparent liquid such as water 63 which reaches the level of the top edge of the insert 62. The (sloping) boundary between the perspex insert 62 and the water 63 constitutes a refracting/totally-internally-reflecting surface giving rise to the visual effects sought by the invention.

The advantage of this construction is economy, since the block 61, having walls of equal thickness throughout, is easily moulded and the insert 62 is of a light, cheap material and in itself has a simple shape to be fabricated.

Although the insert 62 is a transparent solid material, the material need not always have been solid and could have been of a liquid material which could retain its shape, with advantages in manufacture.

Consider the block as shown in FIG. 6*b*, rotated clockwise about 66° so that the oblique boundary of the insert 62 is horizontal. It will be appreciated that into an empty block 61 there may be poured a liquid to set in situ to form the insert 62 of transparent solid material. The insert must then, as before, assume the shape of a right-angled-triangle-section right prism. Suitable liquids are polyesters resin or acrylics. When the liquid is cured, the block may receive the water 63 and be assembled into a module as before.

With this method of forming the insert 62, the blocks 61 could be made either by pressing or, very conveniently, by blowing, using well-developed and low-cost glass bottle blowing technology, as employed for rectangular bottles. The settable liquid to form the insert 62 would be poured in through the aperture of the bottle, held so that what is to become the oblique surface is horizontal until the liquid sets. Then the liquid 63 would be poured in through the same aperture, and then the bottle would be sealed. The position of the aperture can be selected by the manufacturer, but is preferably not in either of the two long vertical faces.

I claim:

1. An article of manufacture in the form of a hollow translucent block having vertical parallel side walls connected to vertical parallel end walls, the side walls being longer than the end walls, the upper surfaces of said side walls and end walls being at least partially flat for engagement with mating structure on another block adapted to be superimposed thereabove, the lower surfaces of said side walls and end walls being at least partially flat for engagement with mating structure on another block adapted for supporting the same from below, said block having a bottom wall and lacking a top wall, the improvement comprising said bottom wall being partially defined by a horizontal portion and partially defined by a portion oblique to the planes of said side walls, liquid within said block with the upper level of the liquid being below, the upper edge of said side walls and in contact with said oblique portion of the bottom wall, such that said liquid cooperates with said oblique portion to transmit at least some light incident on said side walls through said block by total internal reflection.

2. An article in accordance with claim 1 wherein the upper edge of said oblique portion is connected to one of said side walls adjacent the upper end thereof.

3. An article in accordance with claim 1 wherein said liquid is colored.

4. An article in accordance with claim 1 wherein said liquid is water.

5. An article in accordance with claim 1 including a colored gas above the liquid within said block.

6. An article in accordance with claim 1 wherein said oblique portion is defined by a solid transparent prism.

7. An article in accordance with claim 1 wherein the transverse dimension of said bottom wall horizontal portion is greater than the corresponding dimension of said oblique portion.

8. A wall structure of at least two superimposed blocks, said blocks being hollow translucent blocks having vertical parallel side walls connected to vertical parallel end walls, the side walls being longer than the end walls, the upper surfaces of said side walls and end walls on one of said blocks being at least partially flat for engagement with mating structure on another block superimposed thereabove, the lower surfaces of said side walls and end walls on said one block being at least partially flat for engagement with mating structure on another block for supporting the same from below, said blocks lacking a top wall, said blocks having a bottom wall which is partially defined by a horizontal portion and partially defined by a portion oblique to the planes of said side walls and end walls, liquid within said blocks with the upper level of the liquid in said blocks being below the upper edge of said side walls and in contact with said oblique portion of the bottom wall, such that said liquid cooperates with said oblique portion to transmit at least some light incident on said side walls through said blocks by total internal reflection.

9. A wall structure in accordance with claim 8 wherein the upper edge of said oblique portion on said one block is connected to one of said side walls of said one block adjacent the upper end thereof.

* * * * *